US005375174A

United States Patent [19]

Denenberg

[11] Patent Number: 5,375,174

[45] Date of Patent: Dec. 20, 1994

[54] REMOTE SIREN HEADSET

[75] Inventor: Jeffrey N. Denenberg, Trumbull, Conn.

[73] Assignee: Noise Cancellation Technologies, Inc., Linthicum, Md.

[21] Appl. No.: 98,143

[22] Filed: Jul. 28, 1993

[51] Int. Cl.[5] ..... G10K 11/16

[52] U.S. Cl. ..... 381/71

[58] Field of Search ..... 381/25, 71, 74, 72

[56] References Cited

U.S. PATENT DOCUMENTS 4,654,871 3/1987 Chaplin et al. .
4,845,751 7/1989 Schwab .
4,878,188 10/1989 Ziegler, Jr. .

OTHER PUBLICATIONS

M. S. Roden, "Digital Communication Systems Design," Sections 5.6–5.9, 12.1 (1988).
Product Description "Bestlan", A Wireless LAN Interface for PCs.

*Primary Examiner*—Forester W. Isen
*Attorney, Agent, or Firm*—James W. Hiney

[57] ABSTRACT

A wireless remote active noise canceling headset including residual microphones (35, 34) mounted on the headset (30) with speakers (32, 33) located adjacent to the residual microphones and an algorithm driven synchronous controller to operate said headset.

8 Claims, 2 Drawing Sheets

REMOTE SIREN HEADSET

This invention relates to a wireless headset with active noise cancellation using either infra-red or radio frequency control. It is designed to be used in an emergency vehicle where only a small number of wearers are involved and bandwidth limitations are of no concern.

PRIOR ART

Wireless stereo headphones have been available at reasonable cost for several years such as the Sony Model MDR-1F510K, or the monaural Tandy Model 32-2052. They typically use an Infra-Red (IR) link from the music source to the headset. An IR transmitter is connected to the audio output jack of the sound source and generates a modulated IR carrier that fills the room with low level IR energy. This IR signal is picked up at the headset by an optical sensor, the audio is recovered and reproduced by battery operated electronics in the headset. Since the electronics uses very little power, a small battery can operate the remote headset for many hours.

These remote headsets all use Analog communication techniques to pass the information (music) from the source to the wireless remote headset. Digital communication techniques are also currently in use to provide wireless Local Area Network (LAN) connections for personal computers. An example is the "BestLAN" system from the Black Box Corporation which provides a 2 Mbit/second bi-directional communication path between a set of personal computers using the EtherNet Protocols (also known as CSMA/CA-Carrier Sense Multiple Access/Collision Avoidance).

System Identification

Remoting active noise canceling headsets from the controller is feasible and are cost effective. Care must be taken, however, to maintain performance levels to that obtained in a tethered system. Important design considerations include bandwidth, crosstalk, gain stability, and signal to noise ratios. The criticality of the performance of these channels restricts the choice in communication technology to schemes that have predictable performance. Both radio frequency (RF) and infra-red (IR) are feasible but the modulation scheme used should either be digital (i.e., packets or spread spectrum) or narrow-band frequency modulation (FM).

One additional constraint is important. Communication bandwidth is a limited resource. Radio frequency channels are controlled by regulation and only a small number are available for unlicensed portable applications. Infra-red communications for line of sight can provide higher bandwidth, but is also a limited resource. The number of remoted active headsets is therefore limited to a small number in any given facility.

System Considerations

An active noise canceling headset requires two independent, bi-directional communication links for its operation (one more one-way channel may be required if a boom microphone is used for out-going communications). Specific requirements of an Emergency vehicle headset are set forth including digital communication systems which are better suited to this application since it eliminates filters used in the analog modulation and demodulation process that can introduce significant delays in the signal paths. The system requirements are:

Bandwidth—Each ear requires a bi-directional communication channel at the sample rate used by the controller (~10 kHz for the Siren Headset). If there is a need to have a microphone for outgoing communication, a one-way channel at the 10 kHz rate can be added (the anti-noise channels can simultaneously deliver in-coming communications to the wearer's ears with the anti-noise). The number of communication channels are multiplied by the maximum number of headsets worn in the same environment. Since each sample is a 12 bit word in this application four headsets can be supported by a communication system that can continuously handle a 1.5 million bits per second continuous throughput in each direction. This is within the state of the art for wireless data communication systems.

Channel Stability—The noise cancellation system is a feedback control system that requires accurate knowledge of the "Transfer Function" (the response in the Residual signal to a change in the anti-noise output signal). The system can track slow changes in the Transfer Function but head movements should not cause rapid changes. The communication system should therefore operate with a fixed delay per sample in each channel which is determined at either design time or when the system is calibrated in the field.

Communication Delay—Emergency vehicle headset performance is sensitive to the total delay in the system Transfer Function. Even a one sample delay (0.1 millisecond) will produce a noticeable reduction in cancellation performance on the rapidly varying siren noise. Careful design in the communication system can limit the delay to a few bit times (<5 microseconds) in each direction.

The need to minimize delay leads to packaging the Analog/Digital (A/D) converters and associated filters with the headset and using a data communication structure like that currently available in wireless Local Area Networks (LAN) for personal computers. A digital communication system is assumed in the above discussion.

Data Errors—Any errors in the communication system can cause significant sound levels at the ear. They are detected and both the controller and the electronics at the ear react to guarantee stability and minimize the impact of communication errors. Controller strategies that can help include:

Momentarily increasing the "Leakage" parameter in the algorithm.

Smoothing out single errors in the residual signal using the two previous samples and prediction techniques.

The Smoothing strategy also helps at the ear on anti-noise errors. Both ends are shut down smoothly when faced with a high error rate in the communication channel and recover when the communication channels are restored.

Carrier systems that can be used can be either (RF) Radio Frequency or (IR) Infra-Red. Radio frequency is the classical technique of providing a carrier signal (a sine wave at a carrier frequency) and modulating a parameter of that signal (either the Amplitude—for AM, or the frequency—for FM) with the information signal. The modulated carrier can then be sent as an electromagnetic wave from an antenna to a receiving system which can detect the signal and de-modulate it to reproduce the Original information content. In Infra-Red the information is carried by the output of a solid state laser (similar to a Light Emitting Diode—LED but puts out coherent light) like that used in a CD Audio player to read the data from the disk. The two directions can best be separated by using two different "colors" or wavelengths for each transmit/receive pair. The modulation can be analog, but it is easiest to modulate the light output using a digital signal as most of the modulation devices have linearity problems. This is not a problem in this application as the information is already digitally encoded and can be sent in that form. The modulation and multiplexing techniques include frequency modulation (FM) and frequency division multiplexing (FDM). This is the classical system used in FM Broadcast radio today. A separate carrier frequency is chosen for each channel, (this can be a sub-carrier on an optical channel) and the frequency of each carrier is modulated (varied) proportionally to that channel's information signal. A frequency detector is used to recover the information content for each channel.

The carriers are placed far enough apart in frequency so that simple filters can isolate them from the other channels. This, along with the FM capture effect, minimizes crosstalk.

The CSMA/CA (EtherNet) system mentioned in the Prior Art section is a packet communication system. Each data element is packaged in a "Packet" that contains a header with address information, the information element (a chunk of information, e.g., a 12 bit sample) and a trailer that contains redundant information for error detection. Such a system is quite flexible, but is difficult to use in this application. Instead, a Pulse Code Modulation (PCM), Time Division Multiplexing (TDM) and Time Division Multiple Access (TDMA) is used.

This is the preferred embodiment for this single headset system where there is no need to multiplex the channels from different headsets together. This system defines a multi-channel "Frame" in which a time slot is dedicated to each channel. The frames are transmitted at the sample rate (10 kHz) and a sample from each channel is serially transmitted in its time slot. Additional time slots are dedicated to administrative functions such as:

A. Bit and Frame Synchronization—The transmitter and receiver operates at the same speed and agree on time slot assignments.

B. Error Detection—Parity bits are sent as additional bits per channel or a Cyclic Redundancy Check (CRC) word is included in a separate time slot as a check across time slots in each frame.

The reference work (Roden, 1988) describes a similar technique, the 24 channel Telecommunication PCM system called T1 as used in the United States, in Section 5.6. The European equivalent (CEPT) system is a 32 channel system which dedicates channel 0 to synchronization and channel 16 to other administrative functions. The CEPT system operates at 2.048 Mbit/Sec whereas the T1 system operates at 1.544 Mbit/Sec.

These systems can be modified to provide multiple access for additional headsets. The resulting Time Division Multiple Access (TDMA) system is introduced by M.S. Roden in "Digital Communication Systems Design", 1988, Section 5.7.

Spread Spectrum and Code Division Multiple Access (CDMA)—This method has advantages when dealing with multiple interacting entities separated in space. It involves selecting a set of "orthogonal" signals (when multiplied together and averaged over the period of orthogonality the result is zero) and using each one to define an independent communication channel as discussed in Roden, 1988.

The resulting Code Division Multiple Access (CDMA) system is robust and can serve a reasonable number of independent communication channels. It has the drawback of delaying each signal by a time equal to the period of orthogonality of the code and therefore will introduce too much communication delay for this application unless the transmitted bit rate is very high compared to the total data rate.

Accordingly, it is an object of this invention to provide a remote wireless headset for use in emergency vehicles.

Another object is to provide a wireless active cancellation headset using infra-red controls.

A further object is to provide a wireless active cancellation headset using radio frequency controls.

These and other objects will become apparent when reference is had to the accompanying drawings in which.

DETAILED DESCRIPTION

Figure 1:
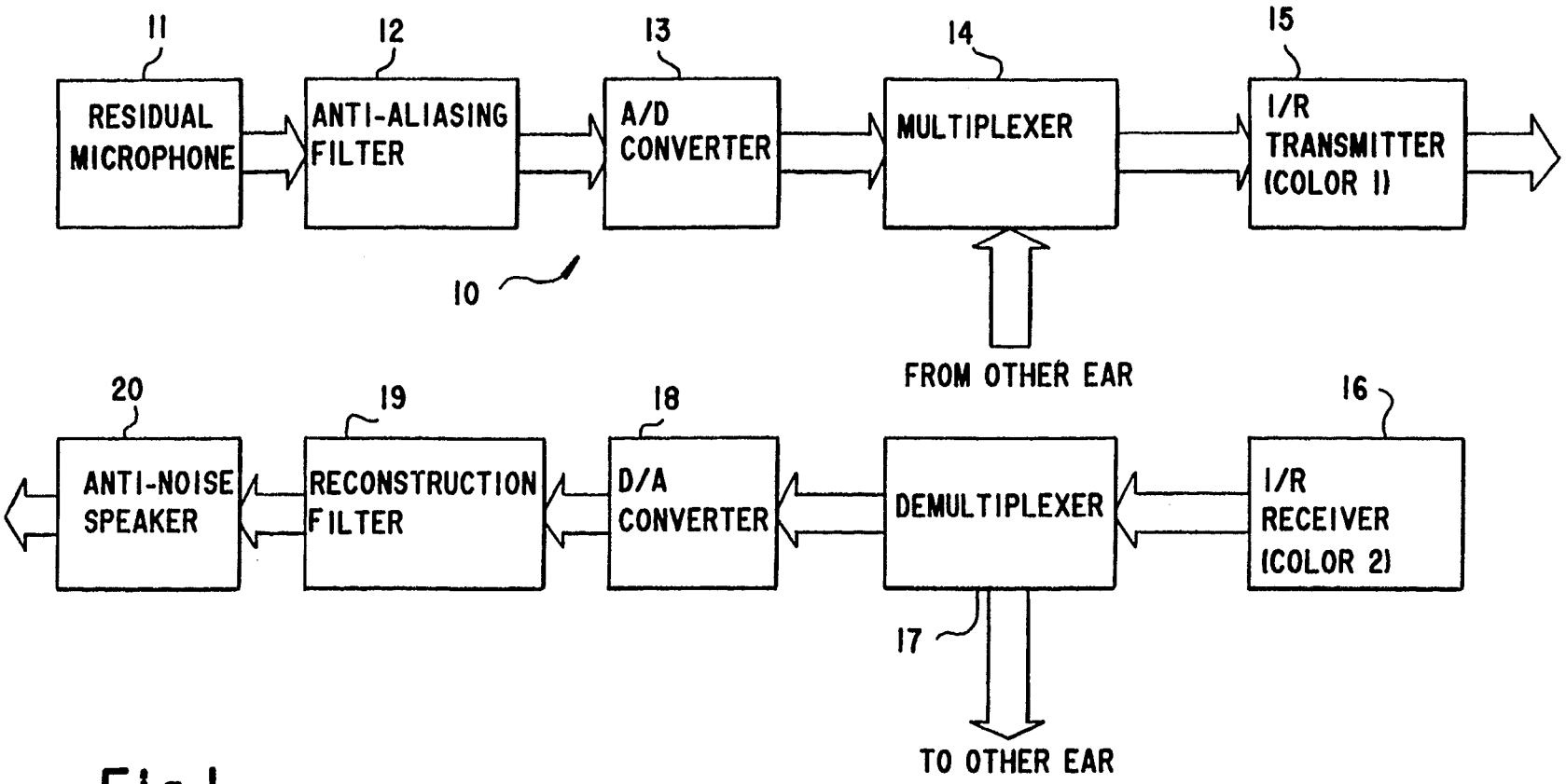
FIG. 1 is a diagrammatic view of headset subsystems.

As described before, the headset subsystem is shown in FIG. 1 as 10. It consists partially of residual microphone 11, anti-aliasing filter 12, A/D converter 13, multiplexer 14 and I/R Transmitter 15. It also includes I/R Receiver 16, de-multiplexer 17, D/A converter 18, re-construction filter 19, and anti-noise speaker 20.

Figure 2:
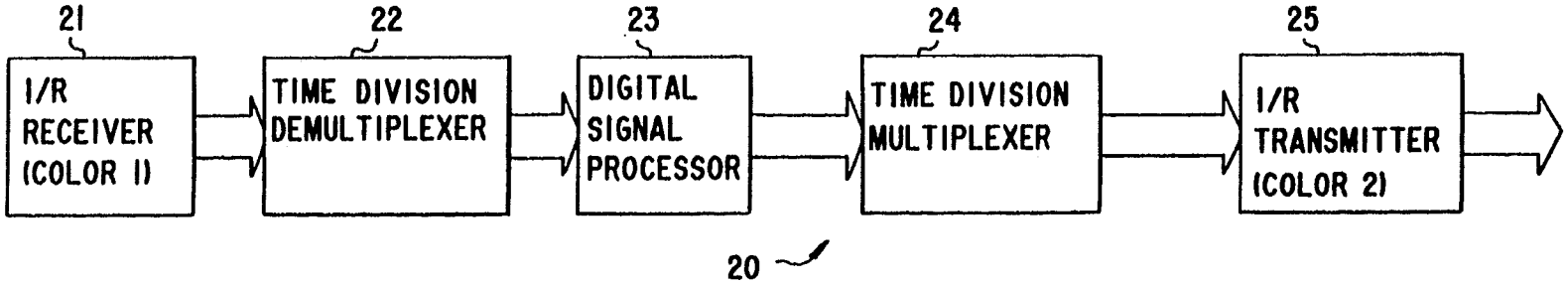
FIG. 2 is a diagrammatic view of a controller subsystem.
Figure 3:
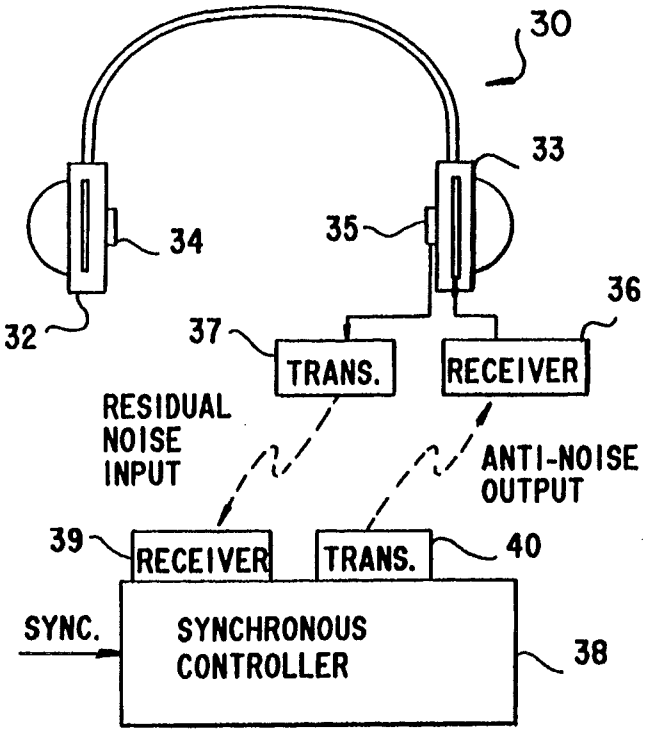
FIG. 3 is a diagrammatic view of a remote headset.

The controller subsystem 20, of FIG. 2 includes I/R Receiver 21, time division demultiplexer 22, digital signal processor 23, time division multiplexer 24 and I/R transmitter 25.

The headset system 30 includes headset 31 with speakers 32,33, residual microphones 34,35 connected, respectively, to receiver 36 and transmitter 37. A synchronous controller 38 is of the type produced by Noise Cancellation Technologies, Inc. and which uses an algorithmic control system as described in U.S. Pat. No. 4,654,871 and U.S. Pat. No. 4,878,188, both hereby incorporated by reference herein. Receiving unit 39 and transmitting unit 40 communicate with 37 and 36, respectively.

Having described the invention attention is directed to the appended claims.

I claim:

1. A wireless remote active noise canceling headset system, said system comprising a headset means, at least one residual microphone means and a first transmission means mounted on said headset means, at least one speaker means mounted on said headset means, a first receiving means, said speaker means operatively connected thereto, a synchronous controller means having a second receiving means and a second transmitting means, said headset means including a first circuit with filter means, an analog to digital converter means and multiplexing means all adapted to process the signal from said microphone means to a form transmittable by said first transmitting means as a noise signal, said controller means having a time division demultiplexer means, a digital signal processor means and a time division multiplexer means to process the signal transmitted by said first transmitting means and received by said second receiving means whereby said noise signal is adjusted and an inverse of said signal is generated by said second transmitting means to said first receiving means to be emitted as sound by said speaker means to cancel undesirable noise adjacent said microphone means.

2. A headset system as in claim 1 wherein said transmitting means and receiving means operate in infra-red frequency signal.

3. A headset system as in claim 2 wherein said synchronous controller means is adapted to run off a sync signal.

4. A headset system as in claim 2 wherein there are two speaker means and two residual microphone means mounted on said headset means.

5. A headset system as in claim 1 wherein said transmitting means and receiving means operate by radio frequency signal,

6. A headset system as in claim 5 wherein said synchronous controller means is adapted to operate off an external sync signal.

7. A headset system as in claim 5 wherein there are two residual microphone means and two speaker means, each one of said microphone means mounted adjacent one said speaker means.

8. A system as in claim 1 wherein said headset means includes a signal demultiplexing means, a digital to analog converter means and a reconstruction filter means to process the signal received by said first receiving means to a form to be emitted by said speaker means.

* * * * *